US005786541A

United States Patent [19]

Komano et al.

[11] Patent Number: 5,786,541

[45] Date of Patent: Jul. 28, 1998

[54] MUSICAL TONE SYNTHESIZING APPARATUS

[75] Inventors: Takeshi Komano; Yoichiro Ogai, both of Hamamatsu, Japan

[73] Assignee: Yamaha Corporation, Hamamatsu, Japan

[21] Appl. No.: 856,628

[22] Filed: May 14, 1997

[30] Foreign Application Priority Data

May 18, 1996 [JP] Japan ..... 8-148318

[51] Int. Cl.[6] ..... G10H 1/057

[52] U.S. Cl. ..... 84/663

[58] Field of Search ..... 84/627, 663, 702, 84/703, 738

[56] References Cited

U.S. PATENT DOCUMENTS 5,272,275 12/1993 Kunimoto .
5,286,916 2/1994 Yamauchi .
5,438,156 8/1995 Masuda et al. .

FOREIGN PATENT DOCUMENTS 5-46179 2/1993 Japan .
5-143079 6/1993 Japan .
6-259087 9/1994 Japan .

*Primary Examiner*—Stanley J. Witkowski
*Attorney, Agent, or Firm*—Graham & James LLP

[57] ABSTRACT

A musical tone synthesizing apparatus is used to synthesize musical-tone waveforms on the basis of simulation of a tone-generation mechanism of a musical instrument. Herein, a drive signal is generated based on an excitation envelope signal in accordance with a manipulation of performance made by a human operator (e.g., performer) and is then converted to an excitation signal in accordance with an operating behavior of the musical instrument. For example, the operating behavior indicates a behavior of a reed portion of a wind instrument to which breath is blown in; or it indicates a behavior of a string of a stringed instrument which is striken or plucked. The excitation signal is input to a physical-model sound source realizing resonating-body/vibrating-body models. The physical-model sound source performs calculations, simulating the tone-generation mechanism of the musical instrument, on the excitation signal to produce a musical tone signal. An amplitude envelope signal as well as an effect are imparted to the musical tone signal, thus providing a synthesized musical tone output. The excitation envelope signal and amplitude envelope signal are controlled in level in a variety of ways in response to an instruction to generate a next note during generation of a current note. For example, formation of an attack portion is started to follow a current level of the excitation envelope signal, whilst the amplitude envelope signal is damped in level to a damp level, then, formation of an attack portion is started to follow the damp level of the amplitude envelope signal. Thanks to the controlling of the envelope signals, it is possible to realize special techniques of performance such as one-note-by-one-note crescendo without causing delay in generation of notes.

10 Claims, 9 Drawing Sheets

MUSICAL TONE SYNTHESIZING APPARATUS

BACKGROUND OF THE INVENTION

1. Field of the Invention

This invention relates to musical tone synthesizing apparatuses, and particularly to musical tone synthesizing apparatuses which use physical-model sound sources to synthesize musical-tone waveforms by simulating tone-generation mechanisms of acoustic instruments.

2. Prior Art

Recently, musical tone synthesizing apparatuses are realized by digital signal processors (DSPs) or microprocessor units (MPUs) with software. Herein, the DSP uses micro-programs as the software, whilst the MPU uses programs as the software. Using them, the musical tone synthesizing apparatuses simulate tone-generation mechanisms of acoustic instruments to synthesize musical-tone waveforms. Those musical tone synthesizing apparatuses provide so-called "physical-model" sound sources, which are disclosed by the papers like Japanese Patent Laid-Open No. 5-143079 (i.e., U.S. Pat. No. 5,438,156).

The physical-model sound source is designed to use an excitation control model section and a resonating-body/vibrating-body model section. Herein, an excitation signal generated by the excitation control section is inputted to the resonating-body/vibrating-body model section to perform calculations which simulate the behavior of the pipe of the wind instrument or the behavior of the string of the stringed instrument. As results of the calculations, the physical-model sound source synthesizes musical tones. Incidentally, the excitation signal corresponds to the breath pressure of the wind instrument or bowing velocity of the stringed instrument. So, the excitation control model section creates the excitation signal based on performance information which is inputted thereto using performance manipulation members of the wind instrument type or performance manipulation members of the violin type, for example.

As described above, the physical-model sound sources are generally designed to generate musical tones by simulating the tone-generation mechanisms of the acoustic instruments. Such a design of the physical-model sound source will inevitably brings a difficulty to the performance of the acoustic instrument as well. For this reason, in some cases, smart skills may be required to generate musical tones accurately in response to the intention of the performer. In addition, there are provided multiple kinds of the performance manipulation members such as the performance manipulation members of the wind instrument type, violin type or pedal type. So, the skills are required for the performer to be accustomed to the above performance manipulation members. That is, the beginners cannot manipulate the apparatus well and fail to generate the sounds.

By the way, if keys of the keyboard are used as the performance manipulation members, musical tones are generated responsive to key-on/key-off signals. In that case, an envelope generator (EG) can be equipped with the musical tone synthesizing apparatus to automatically generate an excitation signal. Thus, it is possible to control generation of musical tones and musical performance by the relatively simple manipulation.

However, the above configuration may not be always effective because it uses an envelope generator to generate an excitation signal in response to a key-on event. In case of the 'real' violin, for example, there are provided complicated performance techniques such as "one-note-by-one-note crescendo". To enable such a performance technique, it is necessary for the apparatus to excite the resonating-body/vibrating-body model section for re-generation of the musical tones in a one-note-by-one-note manner. Generally, the resonating-body/vibrating-body model section requires a great amount of calculations. So, there is a possibility that a delay occurs in generation of musical tones.

SUMMARY OF THE INVENTION

It is an object of the invention to provide a musical tone synthesizing apparatus which is designed to realize an easy control on generation of musical tones as well as an easy control on musical performance without requiring highly advanced skills.

It is another object of the invention to provide a musical tone synthesizing apparatus which is capable of generating musical tones realizing a performance technique of a one-note-by-one-note crescendo of the violin without delays.

A musical tone synthesizing apparatus is used to synthesize musical-tone waveforms on the basis of simulation of a tone-generation mechanism of a musical instrument. Herein, a drive signal is generated based on an excitation envelope signal in accordance with a manipulation of performance made by a human operator (e.g., performer) and is then converted to an excitation signal in accordance with an operating behavior of a musical instrument. For example, the operating behavior indicates a behavior of a reed portion of a wind instrument to which breath is blown in; or it indicates a behavior of a string of a stringed instrument which is striken or plucked. The excitation signal is input to a physical-model sound source realizing resonating-body/vibrating-body models. The physical-model sound source performs calculations, simulating the tone-generation mechanism of the musical instrument, on the excitation signal to produce a musical tone signal. An amplitude envelope signal as well as an effect are imparted to the musical tone signal, thus providing a synthesized musical tone output.

The excitation envelope signal and amplitude envelope signal are controlled in level in a variety of ways in response to an instruction to generate a next note during generation of a current note. For example, formation of an attack portion is started to follow a current level of the excitation envelope signal, whilst the amplitude envelope signal is damped in level to a damp level, then, formation of an attack portion is started to follow the damp level of the amplitude envelope signal. Or, formation of an attack portion is started, without damping, to directly follow a current level of the amplitude envelope signal. Herein, if a current level of the amplitude envelope signal is greater than a predetermined level, the amplitude envelope signal is continuously generated with respect to the generation of the current note, which enables slur performance.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a description will be given with respect to a preferred embodiment of the invention with reference to the drawings.

Figure 1:
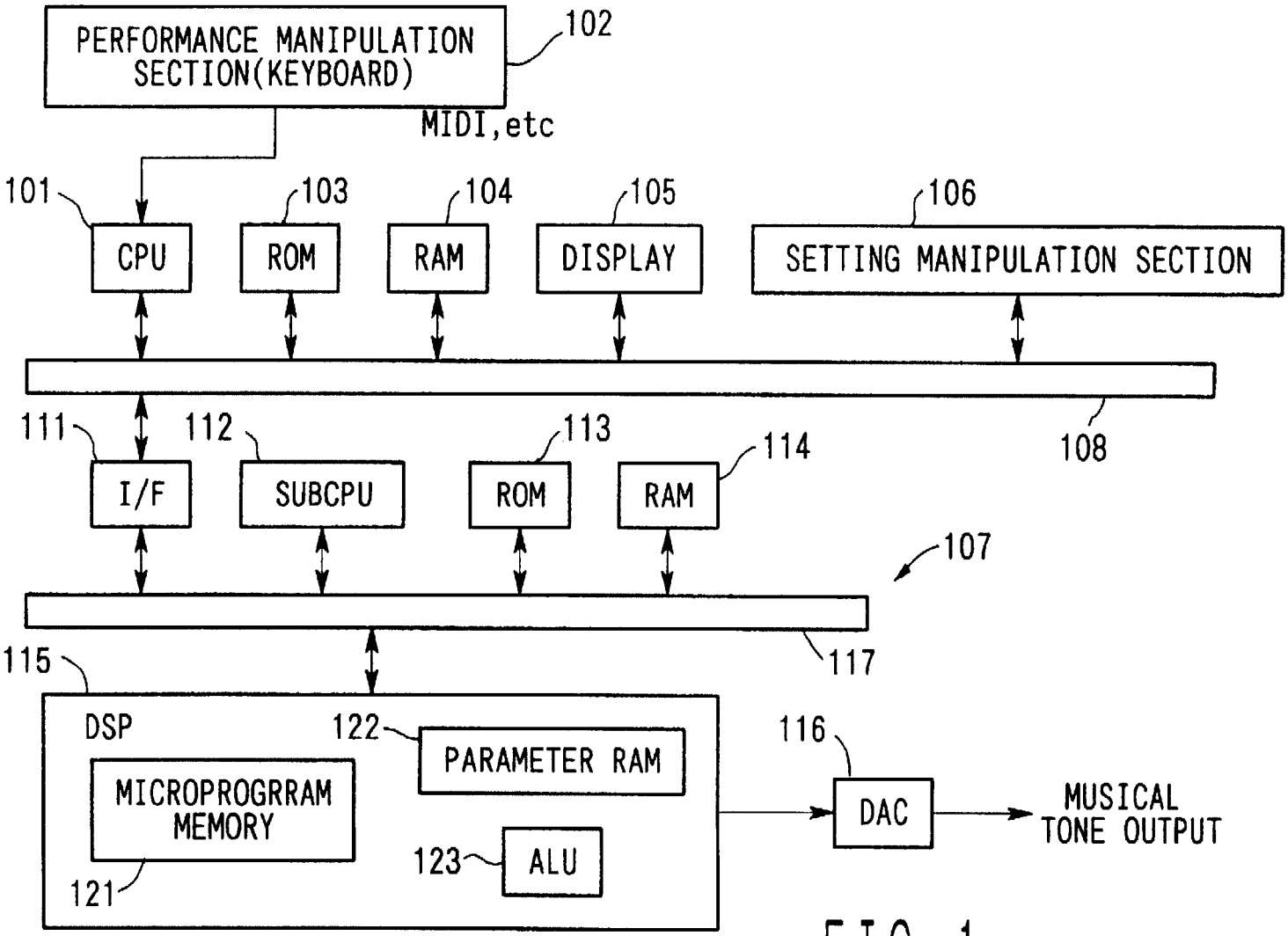
FIG. 1 is a block diagram showing an overall configuration of an electronic musical instrument incorporating functions of a musical tone synthesizing apparatus which is designed in accordance with an embodiment of the invention.

FIG. 1 is a block diagram showing an overall system configuration of an electronic musical instrument incorporating functions of a musical tone synthesizing apparatus in accordance with an embodiment of the invention.

The configuration of the electronic musical instrument of FIG. 1 can be mainly divided into 2 units, for example. A main unit of the electronic musical instrument contains a main central processing unit (i.e., main CPU) 101, a performance manipulation section 102, a read-only memory (ROM) 103, a random-access memory (RAM) 104, a display unit 105, a setting manipulation section 106, a sound source unit 107 and a system bus line 108. The sound source unit 107 contains an interface (I/F) 111, a sub CPU 112, a ROM 113, a RAM 114, a digital signal processor (DSP) 115, a digital-to-analog converter (abbreviated by 'DAC') 116 and a bus line 117. Further, the DSP 115 contains a microprogram memory 121, a parameter RAM 122 and an arithmetic/logic unit (ALU) 123.

The main CPU 101 performs an overall control on the electronic musical instrument. The contents of processing of the main CPU 101 will be described later in conjunction with FIG. 5A. The performance manipulation section 102 contains performance manipulation members which are manipulated by a user (or a performer or a human operator) of the electronic musical instrument. So, the performance manipulation section 102 detects performance manipulation made by the user to output performance information. As the performance manipulation members, it is possible to provide keys of the keyboard, manual operable members of the wind-instrument-type device, or manual operable members of the stringed-instrument-type device, for example. Herein, the wind-instrument-type device equips with a breath sensor which detects breath pressure (or breath-blowing pressure) of the performer; and the stringed-instrument-type device equips with a sensor to detect an external force imparted to a string, e.g., a force of striking a string or a force of plucking a string. The performance manipulation section 102 produces the performance information in the form of MIDI-standard messages (where 'MIDI' indicates the standard for 'Musical Instrument Digital Interface'). For convenience's sake, the MIDI-standard messages are called 'MIDI events'. So, as the performance manipulation section 102, it is possible to employ any kinds of MIDI devices which are capable of outputting the MIDI events to the CPU 101. The ROM 103 stores control programs which the CPU 101 executes as well as a variety of parameters. Storage areas of the RAM 104 are used as work areas for the CPU 101 as well as a variety of buffers. The display unit 105 visually displays a variety of data and information on a screen thereof. The setting manipulation section 106 contains setting manipulation members, i.e., switches such as tone-color-select switches. The aforementioned sections and units denoted by numerals of 101 and 103 to 106 are mutually connected together via the system bus line 108.

The interface 111 provides connections between the system bus line 108 relating to the main CPU 101 and the bus line 117 of the sound source unit 107. The sub CPU 112 performs an overall control on the sound source unit 107. Particularly, the sub CPU 112 performs a tone-generation control on the DSP 115 on the basis of instructions given from the main CPU 101 which are inputted thereto via the interface 111. The contents of processing of the sub CPU 112 will be described later in conjunction with FIGS. 5B, 7A and 7B. The ROM 113 stores control programs which the sub CPU 112 executes as well as a variety of constants. Storage areas of the RAM 114 are used as work areas for the sub CPU 112 as well as a variety of buffers.

The DSP 115 performs calculations, corresponding to functions of the physical-model sound source, based on instructions given from the sub CPU 112. Thus, the DSP 115 synthesizes musical-tone waveforms. Data representing the synthesized musical-tone waveforms are subjected to digital-to-analog conversion made by the DAC 116, so that analog musical tone signals are produced. The aforementioned interface 111, sub CPU 112, ROM 113, RAM 114 and DSP 115 are mutually connected together via the bus line 117.

The microprogram memory 121 of the DSP 115 stores microprograms which the sub CPU 112 sends thereto. The parameter RAM 122 stores parameters (e.g., tone-color parameters) which the sub CPU 112 sends thereto. The ALU 123 executes the microprograms, stored in the microprogram memory 122, to perform calculations of the physical-model sound source using the parameters stored in the parameter RAM 122. Thus, the ALU 123 produces 'digitally synthesized' musical-tone waveforms, data of which are forwarded to the DAC 116.

Incidentally, a single tone-generation channel is set to the sound source unit 107 (or DSP 115). That is, the present embodiment is designed such that notes are sequentially changed over and are sequentially generated by the single tone-generation channel. For example, if the main CPU 101 issues instructions to generate first and second notes successively, the DSP 115 of the sound source unit 107 works as follows:

If the main CPU 101 gives an instruction to generate the first note to the sound source unit 107, then, the main CPU 101 gives another instruction to generate the second note during generation of the first note, the DSP 115 stops generation of the first note but starts generation of the second note.

The invention is characterized by employing a notes-change-over method, content of which is described above. So, the present embodiment is designed to employ a single tone-generation channel. Of course, however, the invention can be easily applied to the musical tone synthesizing apparatus which employs multiple tone-generation channels.

Figure 2:
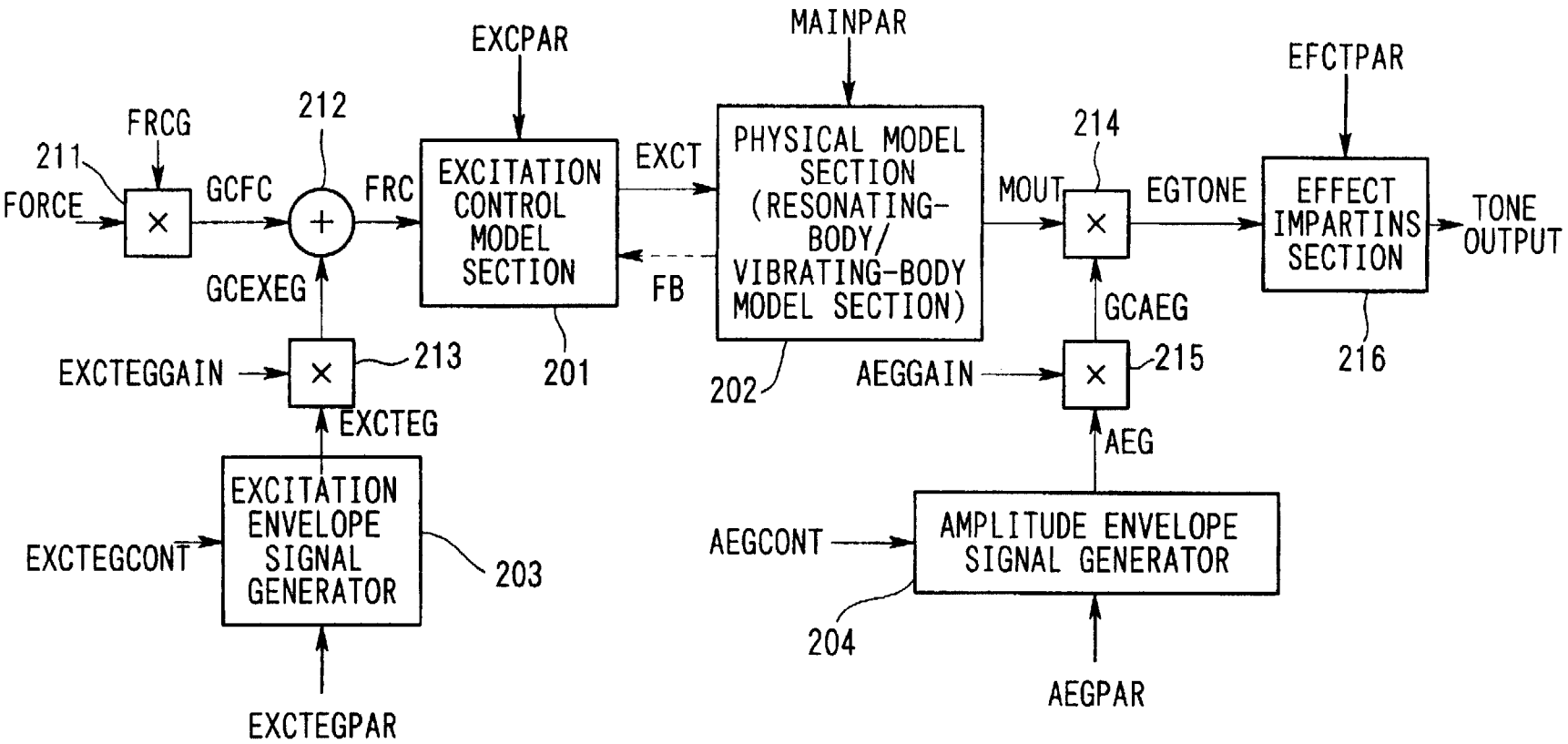
FIG. 2 is a block diagram showing an example of a musical-tone-synthesis algorithm which is realized by a DSP shown in FIG. 1.

FIG. 2 is a block diagram showing an example of a musical-tone-synthesis algorithm which is realized by the DSP 115. Actually, however, musical-tone synthesis based on the musical-tone-synthesis algorithm shown in FIG. 2 is realized by the DSP 115 to execute the microprograms of the microprogram memory 121. The musical-tone-synthesis algorithm of FIG. 2 corresponds to the physical-model sound source simulating the tone-generation mechanisms of the acoustic instruments.

In FIG. 2, an excitation control model section 201 produces an excitation signal EXCT based on a drive signal FRC and an input parameter EXCPAR. The excitation control model section 201 simulates a performance behavior of a musical instrument such as a behavior of a breath-blowing portion (e.g., reed portion) of a wind instrument to which breath is blown in by a player and a behavior of a string of a stringed instrument which is striken or a plucked by a player. A resonating-body/vibrating-body model section 202 (hereinafter, referred to as a physical model section) performs calculations to realize simulation of a basic tone-generation mechanism of an acoustic instrument. Herein, the calculations are performed based on the excitation signal EXCT and a parameter MAINPAR. In short, the physical model section 202 simulates a resonating operation of a pipe portion of a wind instrument through which an air flow is caused to occur due to the blowing breath or a vibrating operation of a string of a stringed instrument. Incidentally, the algorithm of FIG. 2 can be modified as shown by a dotted arrow drawn between the above sections 201 and 202. That is, a feedback signal FB of the physical model section 202 is fed back to the excitation control model section 201 so that the simulation of the excitation control model section 201 reflects a status of the simulation of the physical model section 202. Incidentally, the excitation control model section 201 and the physical model section 202 form a basic configuration for the physical-model sound source.

An excitation envelope signal generator 203, a multiplier 211, an adder 212 and a multiplier 213 form a drive signal creation section which creates the drive signal FRC based on a physical model drive signal FORCE. As described before, the drive signal FRC is input to the excitation control model section 201. The physical model drive signal FORCE is produced in response to a performance manipulation made by a performer (e.g., a user or a human operator). This signal represents information which corresponds to blowing pressure applied to a wind instrument or an external force imparted to a string of a stringed instrument.

Now, we will explain operations to produce the drive signal FRC, as follows:

The multiplier 211 performs multiplication on the physical model drive signal FORCE and a parameter FRCG. Thus, the multiplier 211 produces a result of the multiplication 'GCFC'. The excitation envelope signal generator 203 generates an excitation envelope signal EXCTEG based on an excitation envelope control signal EXCTEGCONT and a parameter EXCTEGPAR. The multiplier 213 performs multiplication on the excitation envelope signal EXCTEG and a parameter EXCTEGGAIN. Thus, the multiplier 213 produces a result of the multiplication 'GCEXEG'. The adder 212 performs addition on outputs of the multipliers 211 and 213, i.e., signals GCFC and GCEXEG. Thus, the adder 212 produces the drive signal FRC.

The aforementioned parameter FRCG represents a gain (i.e., a weighting coefficient) applied to the physical model drive signal FORCE. The parameter EXCTEGGAIN represents a gain applied to the excitation envelope signal EXCTEG. Using the above parameters representing the gains, weighting is performed on the physical model drive signal FORCE and the excitation envelope signal EXCTEG; then, weighted signals are added together by the adder 212 to produce the drive signal FRC.

The aforementioned parameter EXCTEGPAR defines a type and a shape of the excitation envelope signal EXCTEG generated by the excitation envelope signal generator 203. The excitation envelope control signal EXCTEGCONT controls a timing to generate the excitation envelope signal EXCTEG by the excitation envelope signal generator 203.

Figure 3A:
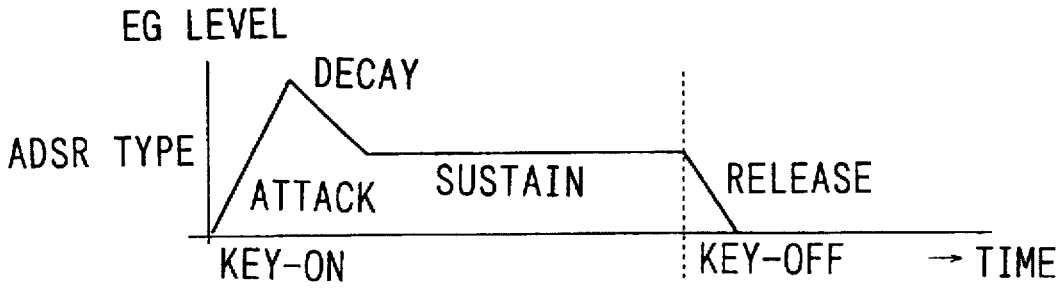
FIGS. 3A and 3B show waveform examples representing excitation envelope signals.
Figure 3B:
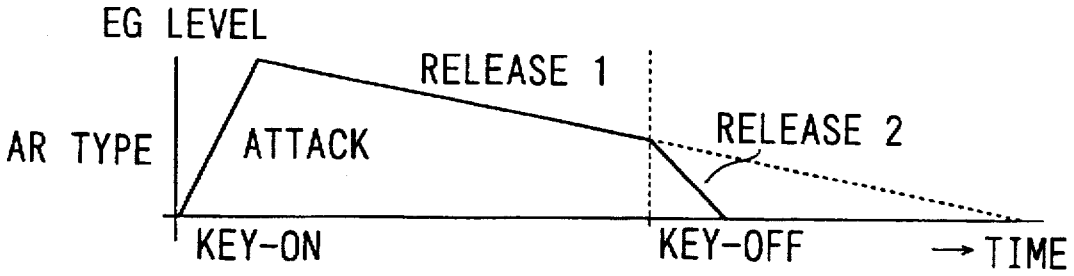

FIGS. 3A and 3B show waveform examples of the excitation envelope signal EXCTEG generated by the excitation envelope signal generator 203. A first waveform example of FIG. 3A corresponds to an ADSR type, whilst a second waveform example of FIG. 3B corresponds to an AR type. Herein, 'ADSR' is an abbreviation for 'Attack-Decay-Sustain-Release' which designate names of portions constructing the typical envelope waveform, whilst 'AR' is an abbreviation for 'Attack-Release'. The aforementioned parameter EXCTEGPAR shows distinction of the above types. In addition, the parameter EXCTEGPAR designates information, which defines a shape of the envelope signal of each type, e.g., an attack rate, an attack level (or a target level for attack). Further, the parameter EXCTEGPAR designates a decay rate and a decay level (or a target level for decay).

When a key-on signal is input to the excitation envelope signal generator 203 as the excitation envelope control signal EXCTEGCONT, the system of the present embodiment starts generation of an envelope signal as shown in FIGS. 3A or 3B. When a key-off signal is input to the excitation envelope signal generator 203 as the excitation envelope control signal EXCTEGCONT, the waveform of the envelope signal decays. That is, in case of the first waveform example corresponding to the ADSR type, a transition occurs from 'sustain' to 'release'. In case of the second waveform example corresponding to the AR type, a transition occurs from 'release 1' to 'release 2'. In the ADSR type, a timing of a transition from 'attack' to 'decay' as well as a timing of a transition from 'decay' to 'sustain' are determined in advance by the parameter EXCTEGPAR. In the AR type, a timing of a transition from 'attack' to 'release 1' is determined in advance by the parameter EXCTEGPAR. So, formation of an envelope waveform is made responsive to a key-on signal or a key-off signal which is sent to the excitation envelope signal generator 203 from an external device (i.e., the sub CPU 112). At a timing to receive the key-on signal, the excitation envelope signal generator 203 starts an elevation of level of the envelope signal to form an attack portion of the waveform. At a timing to receive the key-off signal, the excitation envelope signal generator 203 starts a decrease of level of the envelope signal to form a release portion of the waveform. Incidentally, FIGS. 3A and 3B show the waveform examples, each of which is drawn under the condition where a key-on event occurs in a soundless situation, then, a key-off event occurs. However, the waveform must be differed if a key-on event occurs during generation of a certain note. Such a differed waveform of the envelope signal will be explained later.

Now, back to FIG. 2, the excitation control model section 201 produces the excitation signal EXCT based on the parameter EXCPAR and the drive signal FRC outputted from the adder 212. The physical model section 202 performs calculations, based on the excitation signal EXCT and the parameter MAINPAR, to simulate a tone-generation mechanism of an acoustic instrument. Thus, the physical model section 202 produces a musical tone signal MOUT.

Next, we will explain the content of the processing effected on the musical tone signal MOUT of the physical model section 202, as follows:

An amplitude envelope signal generator 204 generates an amplitude envelope signal AEG based on an amplitude envelope control signal AEGCONT and a parameter AEGPAR. The parameter AEGPAR defines a type and a shape of the amplitude envelope signal AEG generated by the amplitude envelope signal generator 204. The amplitude envelope control signal AEGCONT controls a timing to generate the amplitude envelope signal AEG by the amplitude envelope signal generator 204.

Concrete examples of the waveform representing the amplitude envelope signal AEG, generated by the amplitude envelope signal generator 204, are similar to the aforementioned waveform examples representing the excitation envelope signal EXCTEG (see FIGS. 3A and 3B). Now, we will give a brief explanation on the waveforms representing the amplitude envelope signal AEG, as follows:

When a key-on signal is input to the amplitude envelope signal generator 204 as the amplitude envelope control signal AEGCONT, generation of an envelope signal is started as shown in FIGS. 3A or 3B. When a key-off signal is input to the amplitude envelope signal generator 204 as the amplitude envelope control signal AEGCONT, a transition occurs from 'sustain' to 'release' (or from 'release 1' to 'release 2') in the waveform of FIG. 3A (or FIG. 3B). A timing of the transition is determined in advance by the parameter AEGPAR. The foregoing excitation envelope signal generator 203 receives a key-on signal or a key-off signal as the amplitude envelope control signal EXCTEGCONT. In contrast, the amplitude envelope signal generator 204 has a possibility to input a damp instruction, other than the key-on and key-off signals, as the amplitude envelope control signal AEGCONT. At the inputting of the damp instruction, the amplitude envelope signal generator 204 works to achieve a rapid reduction of level, by which a level of the envelope signal is rapidly reduced by a predetermined rate. In other words, the amplitude envelope signal generator 204 outputs the 'damped' envelope signal whose level is damped at the inputting of the damp instruction.

Next, a multiplier 215 performs multiplication on the amplitude envelope signal AEG and a parameter AEGGAIN. Thus, the multiplier 215 produces a result of the multiplication 'GCAEG'. The parameter AEGGAIN represents a gain applied to the amplitude envelope signal AEG. A multiplier 214 performs multiplication on the musical tone signal MOUT and a multiplied amplitude envelope signal GCAEG which corresponds to the result of the multiplication of the multiplier 215 using the gain AEGGAIN. Thus, an amplitude envelope is imparted to the musical tone signal MOUT. An effect imparting section 216 performs an effect imparting operation (e.g., reverberation imparting operation) based on an effect parameter EFCTPAR, on an amplitude-envelope-imparted musical tone signal EGTONE which corresponds to a result of the multiplication of the multiplier 214. As a result, the effect imparting section 216 produces a final result of the processing of the musical-tone-synthesis algorithm of FIG. 2, i.e., a musical tone signal (TONE OUTPUT).

Examples of the excitation control model section 201 and the physical model section 202 are disclosed by the papers like Japanese Patent Laid-Open Nos. 5-143079, 4-242293 and 4-311995 (i.e., U.S. Pat. Nos. 5,438,156, 5,286,916, 5,272,275). Incidentally, functions representing the resonance characteristic imparting section disclosed by the papers like Japanese Patent Laid-Open Nos. 6-259087 and 5-46179 can be incorporated into the physical model section 202 to provide simulation of a body of a musical instrument such as a violin and/or simulation of an acoustic plate of a piano, for example.

The musical-tone-synthesis algorithm of FIG. 2 is realized by the DSP 115 of FIG. 1 which executes the microprograms of the microprogram memory 121 using the parameters of the parameter RAM 122. The microprograms are loaded to the microprogram memory 121 by an initial setting process which is activated when a power switch of the electronic musical instrument is turned ON. The user is capable of selecting one of tone colors by manipulating the tone-color-select switches of the setting manipulation section 106 in FIG. 1. Then, parameters corresponding to the selected tone color are loaded to the parameter RAM 122 of the DSP 115. The parameters correspond to the aforementioned parameters FRCG, EXCTEGGAIN, EXCTEGPAR, EXCPAR, MAINPAR (wherein pitch-defining parameters defining a tone pitch are excluded), AEGGAIN, AEGPAR and EFCTPAR. Those parameters are determined in response to the selection of the tone color made by the user. Other than the above parameters, the algorithm of FIG. 2 requires inputting of the pitch-defining parameters of MAINPAR as well as inputting of the physical-model drive signal FORCE, the excitation envelope control signal EXCTEGCONT and the amplitude envelope control signal AEGCONT. The above parameters and signals are created by the sub CPU 112 in response to manipulation of the performance manipulation section 102 and are then inputted to the DSP 115.

Next, a description will be given with respect to modes to engage the musical-tone synthesis which is realized by the DSP 115 of FIG. 1 to execute the musical-tone-synthesis algorithm of FIG. 2.

First, we will explain content of an EG control mode. The EG control mode relates to a valid/invalid decision which is made on the excitation envelope signal generator 203 and the amplitude envelope signal generator 204. That is, the EG control mode represents validity of each generator. When the EG control mode is designated, those generators are made valid, so that envelope signals are respectively generated by the excitation envelope signal generator 203 and the amplitude envelope signal generator 204. In other words, those generators are used in the musical-tone-synthesis algorithm of FIG. 2 when the EG control mode is designated. In contrast, if the EG control mode is not designated, both of the excitation envelope signal generator 203 and the amplitude envelope signal generator 204 do not operate; and the parameter FRCG is fixedly set at '1'. As a result, the multiplier 213 normally outputs '0' as the result of multiplication GCEXEG, whilst the multiplier 215 normally outputs '1' as the result of multiplication GCAEG. So, if the EG control mode is not designated, the physical model drive signal FORCE passes through the multiplier 211 and the adder 212 to reach the excitation control model section 201 as the drive signal FRC. In addition, the musical tone signal MOUT outputted from the physical model section 202 passes through the multiplier 214 to reach the effect imparting section 216. A decision whether to designate the EG control mode is made in response to the tone color selected by the user.

Next, we will explain a multi-trigger mode and a single-trigger mode. During designation of the EG control mode, either the multi-trigger mode or the single-trigger mode is alternatively designated. A decision whether to designate the multi-trigger mode or the single-trigger mode is made in response to the tone color selected by the user.

The multi-trigger mode is provided for successive inputting of plural key-on events. In other words, this mode copes with inputting of a new key-on event during generation of a certain note corresponding to a preceding key-on event. That is, in the multi-trigger mode, the amplitude envelope signal generator 204 (see FIG. 2) is re-triggered in response to the inputting of the new key-on event during the generation of the certain note. According to the re-trigger, a level of an amplitude envelope signal is once reduced to zero (or a certain level); then, it is increased again. The multi-trigger mode is designed with respect to a specific tone color whose musical tones are generated one by one like the so-called PCM sound source (where 'PCM' is an abbreviation for 'Pulse Code Modulation'), for example. In the PCM sound source, musical tones are generated in a one-note-by-one-note manner in which generation of a note is started after generation of its previous note is clearly ended.

In contrast to the multi-trigger mode, the single-trigger mode is designed such that a level of an amplitude envelope signal is not reduced to zero but is increased at an input timing of a new key-on event. The single-trigger mode is designated with respect to a specific tone color whose musical tones are generated continuously and successively like the slur performance in which generation of a note is started before completion of generation of its previous note.

By the way, the excitation envelope signal generator 203 generates an excitation envelope signal, regardless of designation of the multi-trigger mode and single-trigger mode. That is, the excitation envelope signal generator 203 works in such a manner that at inputting of a new key-on event, a level of an excitation envelope signal is not reduced to zero but is increased.

As described before, the physical-model sound source has a property to simulate a tone-generation mechanism of an acoustic instrument. So, an electronic musical instrument, employing the physical-model sound source which produces a physical model drive signal under an operation of a breath pressure sensor, for example, is capable of synthesizing a musical tone using an amplitude envelope corresponding to breath pressure which is made by a performer. In general, it is difficult for a beginner to produce sounds using an acoustic wind instrument. So, such a difficulty is reflected by the physical-model sound source as well. In other words, it is difficult for the beginner to produce sounds using the physical-model sound source which simulates the wind instrument. In some cases, a keyboard is used instead of the breath sensor to perform simulation of a wind instrument. However, the keyboard is not capable of producing 'delicate' information representing a small breath pressure delicately made by a performer. In other words, it is not possible to produce an adequate physical model drive signal, so the physical-model sound source, using the keyboard, is not capable of generating a musical tone corresponding to an amplitude envelope adequately matched with a tone color of the wind instrument. In short, the conventional physical-model sound source suffers from an incapability to synthesize musical tones adequately matched with a desired tone color. To cope with such a problem, the present embodiment provides the EG control mode and envelope signal generator to produce a drive signal FRC which is adequately matched with the sounding of a desired tone color. In addition, the present embodiment is designed to impart an amplitude envelope, adequately matched with a desired tone color, to a musical tone. So, the beginner is capable of easily handling the present embodiment to synthesize musical tones, which are adequately matched with the desired tone color and each of which has an amplitude envelope adequately matched with the desired tone color.

In some cases, it is demanded to realize generation of musical tones in a one-note-by-one-note manner like the PCM sound source by the physical-model sound source. This can be realized by the multi-trigger mode of the EG control mode. The above is demanded in special performance techniques such as the one-note-by-one-note crescendo (or stroke crescendo) of the violin and note-by-note performance of the wind instrument. In the above crescendo, the violin is played to produce sounds of a melody line slowly, wherein a bowing speed is suddenly reduced at an end of a note; then, crescendo is made slowly at a timing to start generation of a next note. In the note-by-note performance of the wind instrument, generation of a note is started after generation of a preceding note is completely terminated. Performance control realizing the above performance techniques is hard to be embodied using the breath sensor and keyboard (containing pedal(s)). For this reason, the present embodiment uses the aforementioned multi-trigger mode to impart amplitude envelopes to musical tone signals in a note-by-note manner that generation of a note is started after generation of a preceding note is clearly terminated. Thus, it is possible to easily create a state of the stroke crescendo to enable the note-by-note manner of performance.

In the multi-trigger mode, the amplitude envelope is subjected to re-triggering, whilst the excitation envelope is not subjected to re-triggering because the physical-model sound source normally contains delay. Due to the delay, if the re-triggering is performed such that a level of the excitation envelope is reduced to zero, it takes a time to re-excite the physical model, so there is a possibility that a delay occurs in generation of sound. In contrast, the amplitude envelope is subjected to re-triggering so that the aforementioned note-by-note manner of performance can be realized. Thanks to the above controlling of the envelopes, the physical-model sound source is retained in an excited state, so that a delay can be avoided in generation of sound. As for a certain acoustic instrument such as a wind instrument, the note-by-note manner of performance is not realized by re-blowing breath into a mouthpiece to start generation of a note after clearly terminating generation of a preceding note. Instead of such re-blowing of the breath, the wind instrument is played to enable a transition from one note to another without breaking the blowing of the breath, in other words, with continuing the blowing of the breath. In such a case, the aforementioned single-trigger mode is used to enable increasing of the excitation envelope and amplitude envelope in level without reducing them to zero.

Figure 4A:
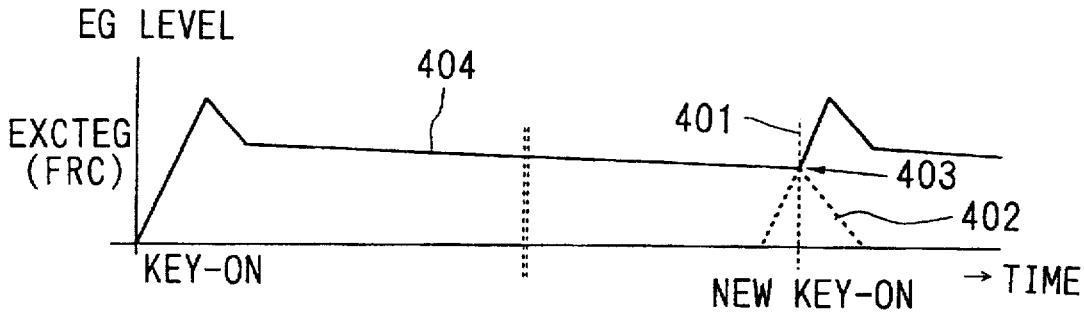
FIGS. 4A to 4C show waveform examples representing envelope signals whose levels are changed to cope with a new key-on event.

FIG. 4A shows a waveform example representing an excitation envelope signal of the aforementioned ADSR type generated by the excitation envelope signal generator 203 to cope with a new key-on event. When a key-on signal is input to the excitation envelope signal generator 203 as the excitation envelope control signal EXCTEGCONT, the excitation envelope signal EXCTEG shows a waveform of a solid line 404 which contains an attack portion, a decay portion and a sustain portion. If a key-off signal is input to the excitation envelope signal generator 203 as the excitation envelope control signal EXCTEGCONT at a timing of a dotted line 401, the waveform of the excitation envelope signal EXCTEG is changed to form a release portion shown by a dotted line 402. On the other hand, if a new key-on signal is input to the excitation envelope signal generator 203 as the signal EXCTEGCONT at the timing of the dotted line 401, the excitation envelope signal EXCTEG is increased from an envelope level '403' to prepare for generation of a next note. In other words, a new attack portion is formed after the timing '401'. The waveform example of FIG. 4A is formed to respond to 2 key-on events which successively occur. However, the excitation envelope signal generator 203 does not perform detection as to whether or not generation of a previous note still continues at an input timing of the new key-on signal. That is, the excitation envelope signal generator 203 is designed in such a simple way that formation of a new attack portion is started responsive to inputting of a new key-on signal although the excitation envelope signal is sustained at a certain level.

Figure 4B:
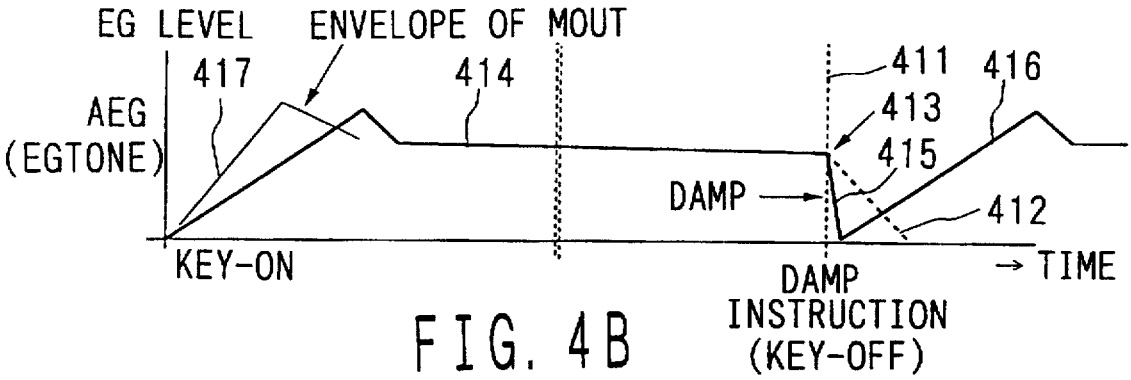

FIG. 4B shows a waveform example representing an amplitude envelope signal of the aforementioned ADS type generated by the amplitude envelope signal generator 204 to cope with a new key-on event in the multi-trigger mode. When a key-on signal is input to the amplitude envelope signal generator 204 as the amplitude envelope control signal AEGCONT, the amplitude envelope signal AEG shows a waveform of a solid line 414 which contains an attack portion, a decay portion and a sustain portion. Even if the musical tone signal MOUT, outputted from the physical model section 202, shows a waveform of a solid line 417, an amplitude envelope representing the waveform of the solid line 414 is imparted to musical tone signal MOUT, so it is possible to synthesize musical tones which vary in a slow crescendo manner. If a key-off signal is input to the amplitude envelope signal generator 204 as the amplitude envelope control signal AEGCONT, the waveform of the amplitude envelope signal AEG is changed to form a release portion shown by a dotted line 412. By the way, if generation of a next note is designated during generation of a note in the multi-trigger mode, the sub CPU 112 sends a damp instruction to the amplitude envelope signal generator 204, wherein details of the operation of the sub CPU 112 will be described later. Suppose a situation that a damp instruction is input to the amplitude envelope signal generator 204 at a timing of a dotted line 411 as the amplitude envelope control signal AEGCONT. In such a situation, the amplitude envelope signal AEG is damped so that a level thereof is reduced along with a solid line 415 from an envelope level '413'. When the sub CPU 112 detects that a level of the amplitude envelope signal AEG reaches zero or becomes lower than a certain level, the sub CPU 112 sends a key-on signal to the amplitude envelope signal generator 204 as the amplitude envelope control signal AEGCONT. Responding to such a new key-on signal, the amplitude envelope signal generator 204 increases the amplitude envelope signal AEG in level along with a solid line 416 to prepare for generation of a next note. Incidentally, the amplitude envelope signal generator 204 does not perform detection as to whether or not generation of a preceding note is continued at a timing to input the new key-on signal representing a next note to be generated. In other words, the amplitude envelope signal generator 204 is simply designed such that it starts to form an attack portion whose level starts from the level of the envelope signal at the timing of the new key-on event. Incidentally, a decision whether to perform damping is made based on an instruction given from the sub CPU 112.

Figure 4C:
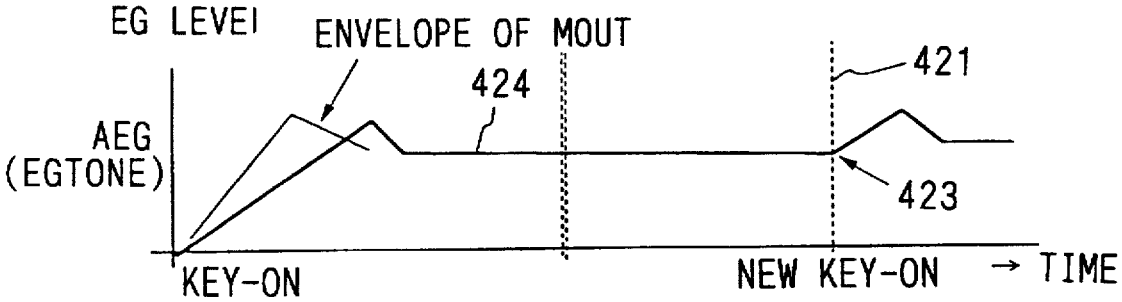

FIG. 4C shows a waveform example representing the amplitude envelope signal AEG of the aforementioned ADSR type, generated by the amplitude envelope signal generator 204, in the single-trigger mode to cope with a new key-on event. When a key-on signal is input to the amplitude envelope signal generator 204 as the amplitude envelope control signal AEGCONT, the amplitude envelope signal AEG shows a waveform of a solid line 424 which contains an attack portion, a decay portion and a sustain portion. Next, when a new key-on signal is input to the amplitude envelope signal generator 204 as the amplitude envelope control signal AEGCONT at a timing of a dotted line 421, the amplitude envelope signal generator 204 increases the amplitude envelope signal AEG in level from an envelope level '423' to prepare for generation of a next note.

Next, operations of the main CPU 101, the sub CPU 112 and the DSP 115 will be described with reference to flowcharts.

Figure 5B:
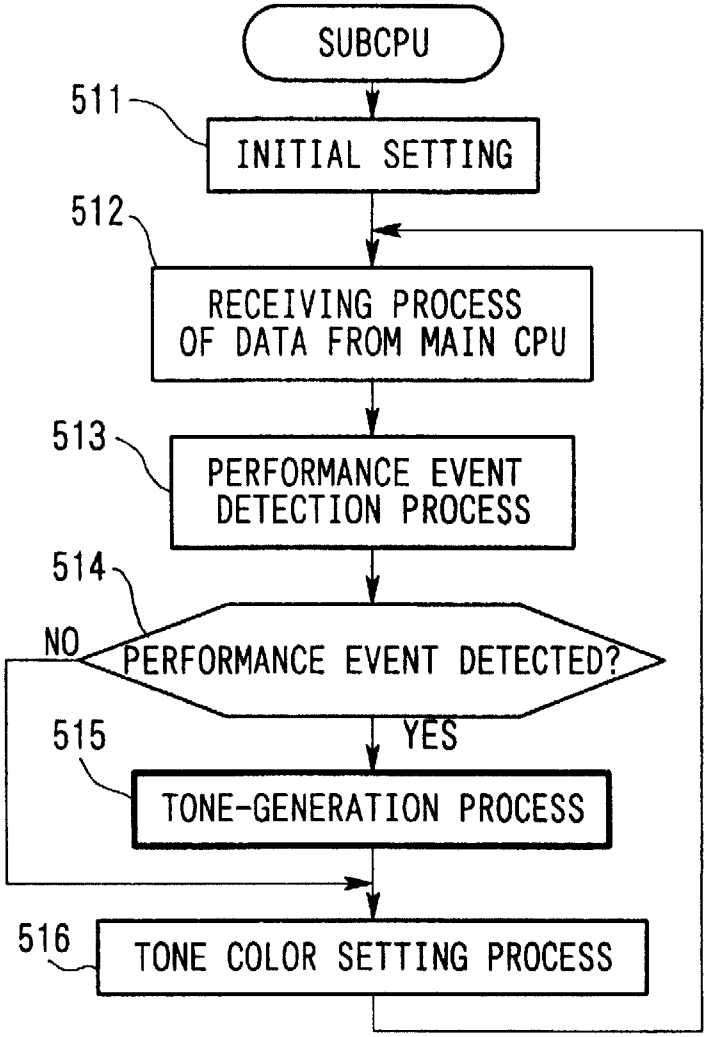
FIG. 5B is a flowchart showing a sub CPU program.
Figure 5A:
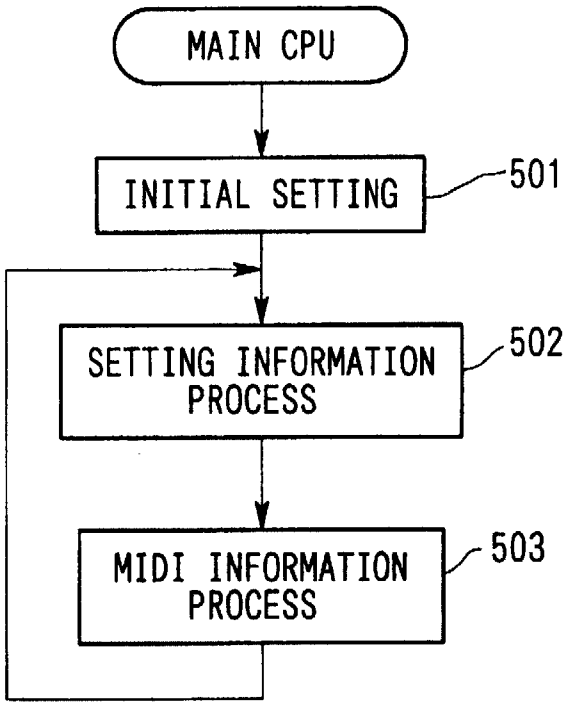
FIG. 5A is a flowchart showing a main program.

FIG. 5A shows a main program executed by the main CPU 101 after a power switch of the electronic musical instrument is turned ON. In step 501, the main CPU 101 performs an initial setting process on a variety of sections, units and circuits of the electronic musical instrument. Thereafter, the main CPU 101 performs a setting information process of step 502 and a MIDI information process of step 503. After completion of the step 503, a program control goes back to the step 502. In the setting information process of step 502, the main CPU 101 performs detection on manipulation applied to members of the setting manipulation section 106 shown in FIG. 1. So, the setting corresponding to the detected manipulation is made on the electronic musical instrument. For example, the user manipulates some member(s) to select a tone color. In that case, tone-color-setting data (or tone-color-setting event(s)), containing tone-color information representing the selected tone color, are transferred to the sound source unit 107. Or, it is possible to modify the present embodiment such that tone-color-setting data (or tone-color-setting event(s)), containing tone-color parameters which are set by the users individually, are transferred to the sound source unit 107. In the MIDI information process of step 503, the main CPU 101 performs processes regarding MIDI events inputted thereto. For example, a MIDI event (i.e., performance information), given from the performance manipulation section 102, is input to the main CPU 101. In that case, a performance event (i.e., tone-generation control instruction), corresponding to the inputted MIDI event, is transferred to the sound source unit 107.

FIG. 5B shows a sub CPU program which is executed by the sub CPU 112, provided inside of the sound source unit 107, after the power switch of the electronic musical instrument is turned ON. In step 511, the sub CPU 112 performs an initial setting process on a variety of sections and circuits of the sound source unit 107. In the initial setting process, the sub CPU 112 accesses to the ROM 113 or RAM 114 to read out microprograms (i.e., programs realizing the musical-tone-synthesis algorithm of FIG. 2), which are then transferred to the DSP 115. So, the microprograms are loaded into the microprogram memory 121, so that the sub CPU 112 starts operation of the DSP 115. Details of the operation of the DSP 115 will be described later in conjunction with FIG. 6. In step 512, the sub CPU 112 performs a receiving process to receive data which are transferred thereto from the main CPU 101. In step 513, the sub CPU 112 performs a detection process to detect a performance event from receiving data thereof. So, if the main CPU 101 outputs a performance event in step 503 of the main program of FIG. 5A, the sub CPU 112 detects it in step 513. In step 514, the sub CPU 112 performs a decision as to whether or not a performance event exists. If the performance event exists, the sub CPU 112 proceeds to step 515 to perform a tone-generation control process, details of which will be described later with reference to FIGS. 7A and 7B. If not, the sub CPU 112 directly proceeds to step 516. In step 516, the sub CPU 112 performs a tone-color-setting process. Thereafter, a program control goes back to the step 512.

The tone-color-setting process of step 516 is activated when the main CPU 101 outputs a tone-color-setting event in step 502 shown in FIG. 5A. That is, tone-color parameters, corresponding to a tone color designated by the tone-color-setting event, are read out from the ROM 113 or the RAM 114, so that they are transferred to the parameter RAM 122 of the DSP 115. If tone-color parameters which are set by the users individually are sent to the sub CPU 112, they are transferred to the parameter RAM 122 of the DSP 115. The parameters, which are loaded into the RAM 122 by the tone-color-setting process of step 516, contain the aforementioned parameters shown in FIG. 2, i.e., FRCG, EXCTEGGAIN, EXCTEGPAR, EXCPAR, MAINPAR (excluding pitch-defining parameters), AEGGAIN, AEGPAR and EFCTPAR. Other parameters (i.e., FORCE, EXCTEGCONT, AEGCONT as well as the pitch-defining parameters of MAINPAR) are transferred to the DSP 115 in the tone-generation control process of step 515.

Figure 6:
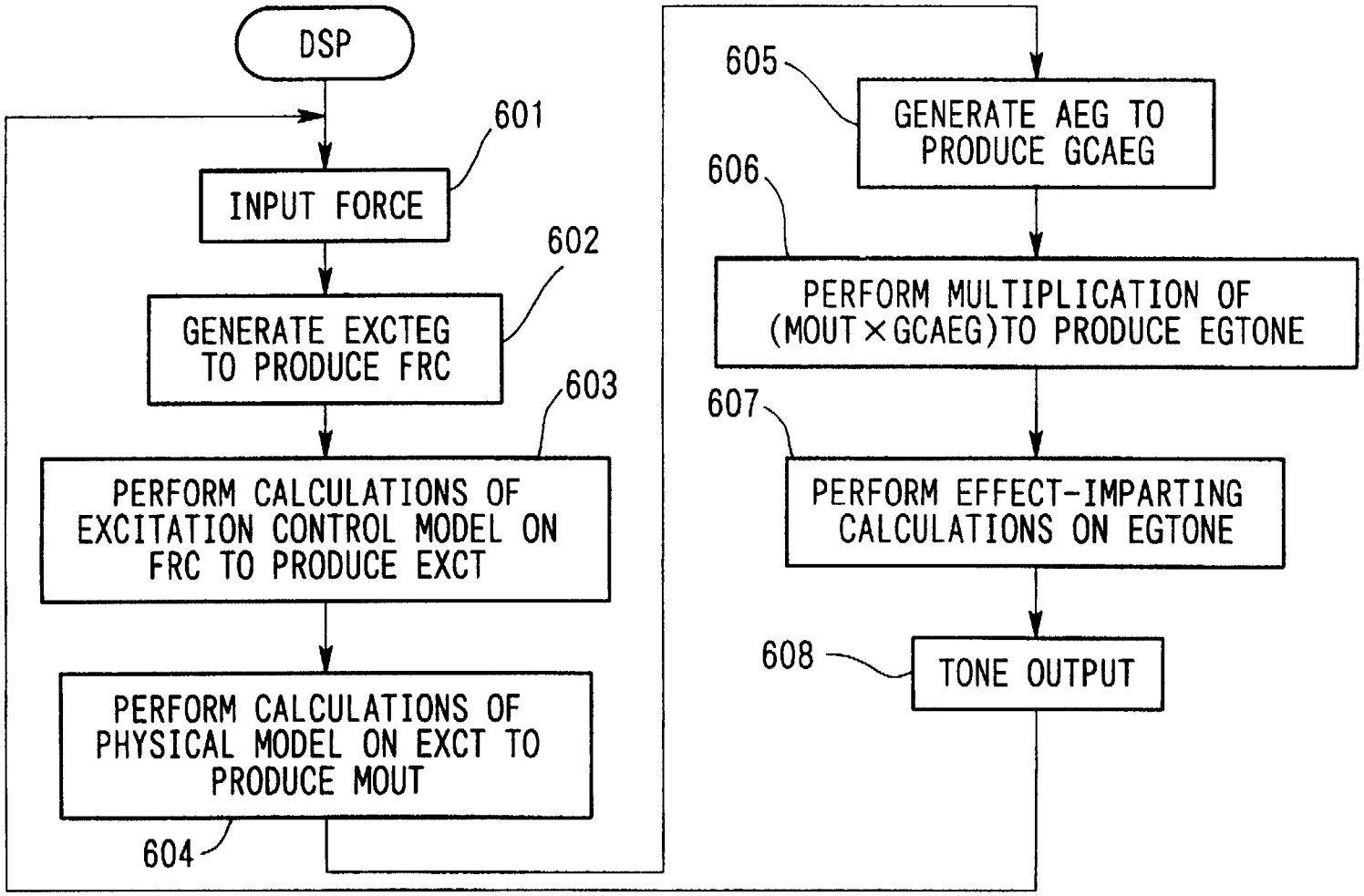
FIG. 6 is a flowchart showing a DSP program.

FIG. 6 is a flowchart showing procedures of digital signal processing performed by the DSP 115 provided inside of the sound source unit 107 shown in FIG. 1. That is, the flowchart shows procedures to realize the aforementioned musical-tone-synthesis algorithm of FIG. 2 by the DSP 115. In step 511 of FIG. 5B, the sub CPU 112 loads microprograms into the microprogram memory 121 of the DSP 115 to start operation of the DSP 115. Thus, the digital signal processing of the DSP 115 shown in FIG. 6 is started. Thereafter, the DSP 115 repeats a series of steps 601 to 608 by every sampling period (or cycle).

In step 601, the DSP 115 (hereinafter, simply referred to as 'DSP') inputs the physical-model drive signal FORCE, so that the DSP initiates a process of the multiplier 211 to perform multiplication using the parameter FRCG. Thus, the DSP provides a result of the multiplication 'GCFC'. In step 602, the DSP initiates a process of the excitation envelope signal generator 203 to generates the excitation envelope signal EXTEG. In addition, the DSP initiates a process of the multiplier 213 to perform multiplication using the parameter EXCTEGGAIN. Thus, the DSP provides a result of the multiplication 'GCEXEG'. Then, the DSP initiates a process of the adder 212 to perform addition on GCEXEG and GCFC. Thus, the DSP provides a result of the addition 'FRC'. In step 603, the DSP performs calculations of the excitation control model section 201 on the basis of FRC and the parameter EXCPAR so as to calculate the excitation signal EXCT. By the way, it is possible to incorporate the feedback signal FB, given from the physical model section 202, into the basis of the calculations. In step 604, the DSP performs calculations of the physical model section 202 on the basis of the parameter MAINPAR and the excitation signal EXCT calculated in step 603. Thus, the DSP produces the musical tone signal MOUT.

In step 605, the DSP initiates a process of the amplitude envelope signal generator 204 to generate the amplitude envelope signal AEG. In addition, the DSP initiates a process of the multiplier 215 to perform multiplication using the parameter AEGGAIN. Thus, the DSP provides a result of the multiplication 'GCAEG'. In step 606, the DSP initiates a process of the multiplier 214 to perform multiplication on MOUT, produced by the step 604, and GCAEG produced by the step 605. Thus, the step 606 produces a result of the multiplication 'EGTONE'. In step 607, the DSP initiates a process of the effect imparting section 216 to perform effect-imparting calculations on EGTONE. In step 608, the DSP outputs a result of the step 607 as the musical tone output (TONE OUTPUT). After completion of the step 608, a program control goes back to the step 601. Thus, the DSP repeats a series of the steps 601 to 608.

In some case, the user selects a tone color for which, however, the EG control mode is not designated. In that case, corresponding parameters are sent to the DSP 115. Thus, the DSP performs processes, matched with non designation of the EG control mode, in accordance with the procedures shown in FIG. 6. Incidentally, the contents of the above processes, matched with the non designation of the EG control mode, are described before with reference to FIG. 2.

Figure 7A:
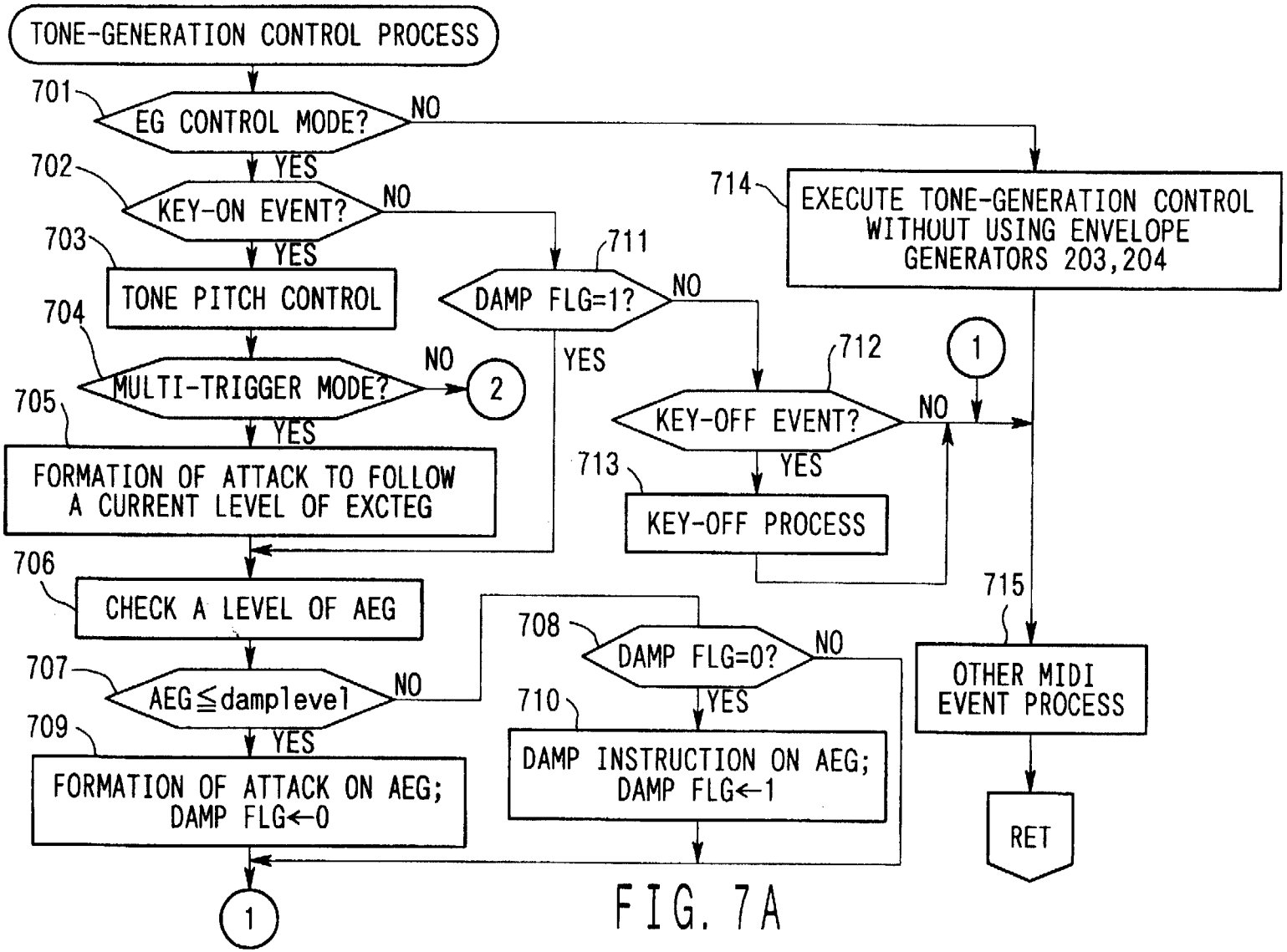
FIGS. 7A and 7B are flowcharts showing a tone-generation control process executed in the sub CPU program of FIG. 5B.
Figure 7B:
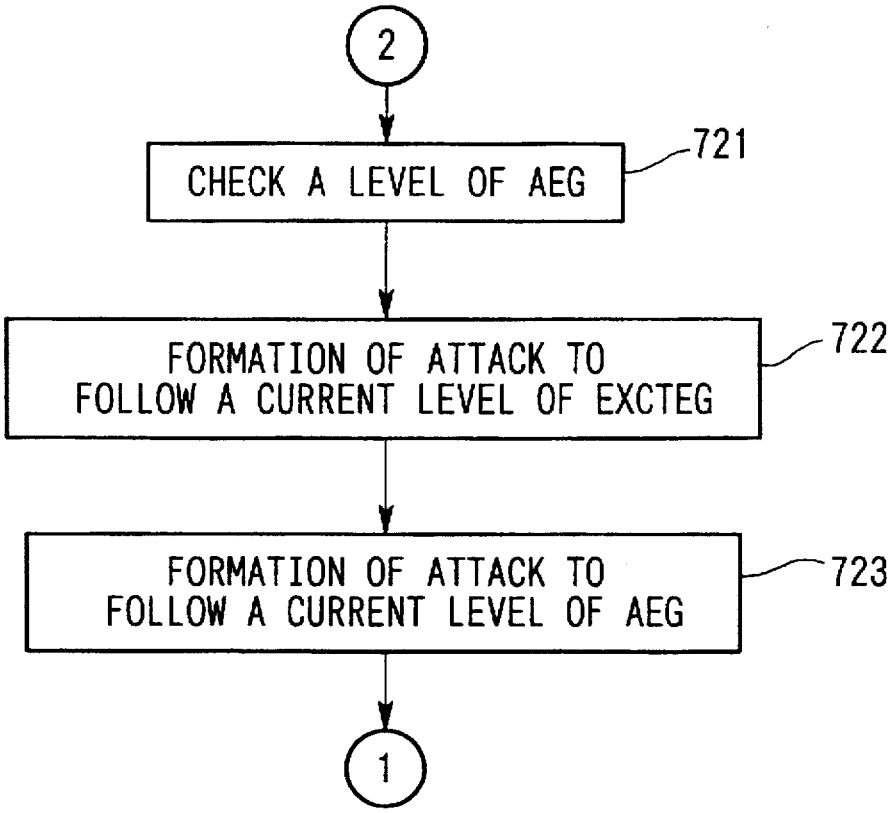

FIGS. 7A and 7B are flowcharts showing procedures of the tone-generation control process of step 515 shown in FIG. 5B. In the tone-generation control process, the sub CPU 112 firstly proceeds to step 701 that a decision is made as to whether or not the EG control mode is designated for a tone color currently selected. If the EG control mode is not designated, the sub CPU 112 proceeds to step 714 to create parameters based on MIDI information given from the main CPU 101. Herein, the created parameters correspond to the physical-model drive signal FORCE, excitation envelope control signal EXCTEGCONT, amplitude envelope control signal AEGCONT, as well as pitch-defining parameters of MAINPAR which define a tone pitch. Those parameters are sent to the DSP 115. Thus, the sub CPU 112 performs a tone-generation control in accordance with selected parts of the algorithm of FIG. 2 which excludes the excitation envelope signal generator 203 and the amplitude envelope signal generator 204. After completion of the step 714, the sub CPU 112 performs other processes corresponding to MIDI events. Thereafter, the sub CPU 112 ends an execution of the tone-generation control process.

If the sub CPU 112 detects in step 701 that the EG control mode is designated for the tone color currently selected, it proceeds to step 702. In step 702, a decision is made as to whether or not the MIDI information given from the main CPU 101 designates a key-on event. In case of the key-on event, the sub CPU 112 proceeds to step 703 to perform a tone pitch control. Herein, tone pitch information representing a tone pitch designated by the user is extracted from the MIDI information. So, the sub CPU 112 sends the physical-model drive signal FORCE and the pitch-defining parameters of MAINPAR to the DSP 115 such that a musical tone having the designated tone pitch is generated.

After completion of step 703, the sub CPU 112 proceeds to step 704 that a decision is made as to whether the user designates the multi-trigger mode or the single-trigger mode. In case of the multi-trigger mode, the sub CPU 112 proceeds to step 705. Herein, a key-on signal is sent to the DSP 115 as the excitation envelope control signal EXCTEGCONT such that formation of an attack portion is started from a current envelope level of the excitation envelope signal EXCTEG.

In step 706, the sub CPU 112 checks a level of the amplitude envelope signal AEG. In step 707, a decision is made as to whether or not the level of the amplitude envelope signal AEG matches with an inequality of AEG≦damplevel. If the level of the amplitude envelope signal AEG is equal to or less than a certain damp level (damplevel), the sub CPU 112 proceeds to step 709. In step 709, a key-on signal is sent to the DSP 115 as the amplitude envelope control signal AEGCONT such that formation of an attack portion is started with respect to the amplitude envelope signal AEG. In addition, a damp flag (damp FLG) is cleared; in other words, '0' is set to the damp flag. Then, the sub CPU 112 proceeds to the aforementioned step 715. In the case where the sub CPU 112 detects in step 707 that the level of the amplitude envelope signal AEG is greater than the damp level (damplevel), it can be said that damping has not been sufficiently performed on the amplitude envelope signal AEG. In that case, the sub CPU 112 proceeds to step 708 that a decision is made as to whether or not '0' is set to damp FLG. If the sub CPU 112 detects that '0' is set to the damp flag, it proceeds to step 710. In step 710, a damp instruction is sent to the DSP 115 as the amplitude envelope control signal AEGCONT such that the amplitude envelope signal AEG is damped. In addition, '1' is set to the damp flag. After completion of the step 710, the sub CPU 112 proceeds to step 715.

An initial value of the damp flag is '0', but '1' is set to the damp flag when damping should be performed on the amplitude envelope signal AEG. Under a state where the damp flag is initially set at '0', if the sub CPU 112 detects in step 707 that a level of the amplitude envelope signal AEG is greater than the damp level (damplevel), in other words, if an amplitude level of a musical tone which is currently generated is greater than a certain level, the amplitude envelope signal AEG is changed in level as shown in FIG. 4B. That is, damping is performed on the amplitude envelope signal AEG; then, formation of an attack portion is started for generation of a next note. In order to enable such a level control on the amplitude envelope signal AEG, the sub CPU 112 proceeds to step 710 via step 708. In step 710, a damp instruction is made with respect to the amplitude envelope signal AEG; and '1' is set to the damp flag. Until the amplitude envelope signal AEG is damped in level to reach the certain level, a series of the steps 707, 708 and 715 are repeated. When the amplitude envelope signal AEG is damped in level to be lower than the certain level, the sub CPU 112 proceeds to step 709 via step 707. In step 709, formation of an attack portion is made on the amplitude envelope signal AEG to prepare for generation of a next note; and the damp flag is reset to '0'.

If the sub CPU 112 detects in step 702 that the MIDI information given from the main CPU 101 does not relate to a key-on event, it proceeds to step 711 that a decision is made as to whether or not '1' is set to the damp flag. An event that the damp flag is '1' indicates a damping state where damping is currently made on the amplitude envelope signal AEG. In such an event, the sub CPU 112 proceeds to step 706 via step 711. On the other hand, if the damp flag is not '1' (i.e., the damp flag is '0'), the sub CPU 112 proceeds to step 712 via step 711. In step 712, a decision is made as to whether or not the MIDI information given from the main CPU 101 relates a key-off event. In case of the key-off event, the sub CPU 112 proceeds to step 713 to perform a key-off process. In the key-off process, a key-off signal is sent to the DSP 115 as the excitation envelope control signal EXCTEGCONT and amplitude envelope control signal AEGCONT while the physical model drive signal FORCE is sent to the DSP 115 as well. Due to the key-off process, each envelope signal is subjected to transition to a release portion. After completion of step 713, the sub CPU 112 proceeds to step 715. If the sub CPU 112 detects in step 712 that the MIDI information does not relate to the key-off event, it directly proceeds to step 715.

If the single-trigger mode is designated in step 704, the sub CPU 112 proceeds to step 721 shown in FIG. 7B. In step 721, the sub CPU 112 checks a current level of the amplitude envelope signal AEG. In next step 722, a key-on signal is sent to the DSP 115 as the excitation envelope control signal EXCTEGCONT such that formation of an attack portion is started from a current level of the excitation envelope signal EXCTEG. In step 713, a key-on signal is sent to the DSP 115 as the amplitude envelope control signal AEGCONT such that formation of an attack portion is started from the current level of the amplitude envelope signal AEG. After completion of step 713, the sub CPU 112 proceeds to step 715 shown in FIG. 7A.

Incidentally, the present embodiment is designed in such a way that the sub CPU 112 manages operations of the DSP 115. However, it is possible to modify the present embodiment such that the main CPU 101 directly manages the DSP 115. In addition, the present embodiment uses the DSP to perform synthesis of musical tones. However, this invention is not limited in usage of the DSP. So, it is possible to employ other electronic components (or processing devices) which are capable of realizing the algorithm of FIG. 2.

The musical-tone-synthesis algorithm of FIG. 2 requires inputting of the parameter FORCE, based on the performance information inputted by the performance manipulation section 102, to create the drive signal FRC. It is possible to modify the algorithm of FIG. 2 such that the drive signal FRC is created using the envelope signal generated by the excitation envelope signal generator 203 only. In addition, the algorithm of FIG. 2 creates the drive signal FRC by adding GCFC and GCEXEG together. It is possible to modify the algorithm such that a selector is introduced to select either GCFC or GCEXEG as the drive signal FRC. Further, the algorithm of FIG. 2 is designed such that both of the excitation envelope signal generator 203 and amplitude envelope signal generator 204 are made valid or invalid on the basis of the designation of the EG control mode. It is possible to modify the algorithm such that each of the excitation envelope signal generator 203 and the amplitude envelope signal generator 204 is individually made valid or invalid.

Moreover, the present embodiment is designed such that in case of the single-trigger mode, formation of an attack portion is started from a current level of an envelope signal (see FIG. 7B). It is possible to modify the present embodiment to cope with slur performance or an instruction to generate a next note which is made under a state where an envelope signal of a preceding note is not sufficiently damped. In that case, the envelope signal of the preceding note is continuously used for the generation of the next note. Such a special control on the level of the envelope signal differs with respect to the aforementioned ADSR type and AR type, for example. In case of the ADSR type, a transition is made from the current level of the envelope waveform to the decay portion or sustain portion. In case of the AR type, a transition is made from the current level of the envelope waveform to the release portion.

Figure 8:
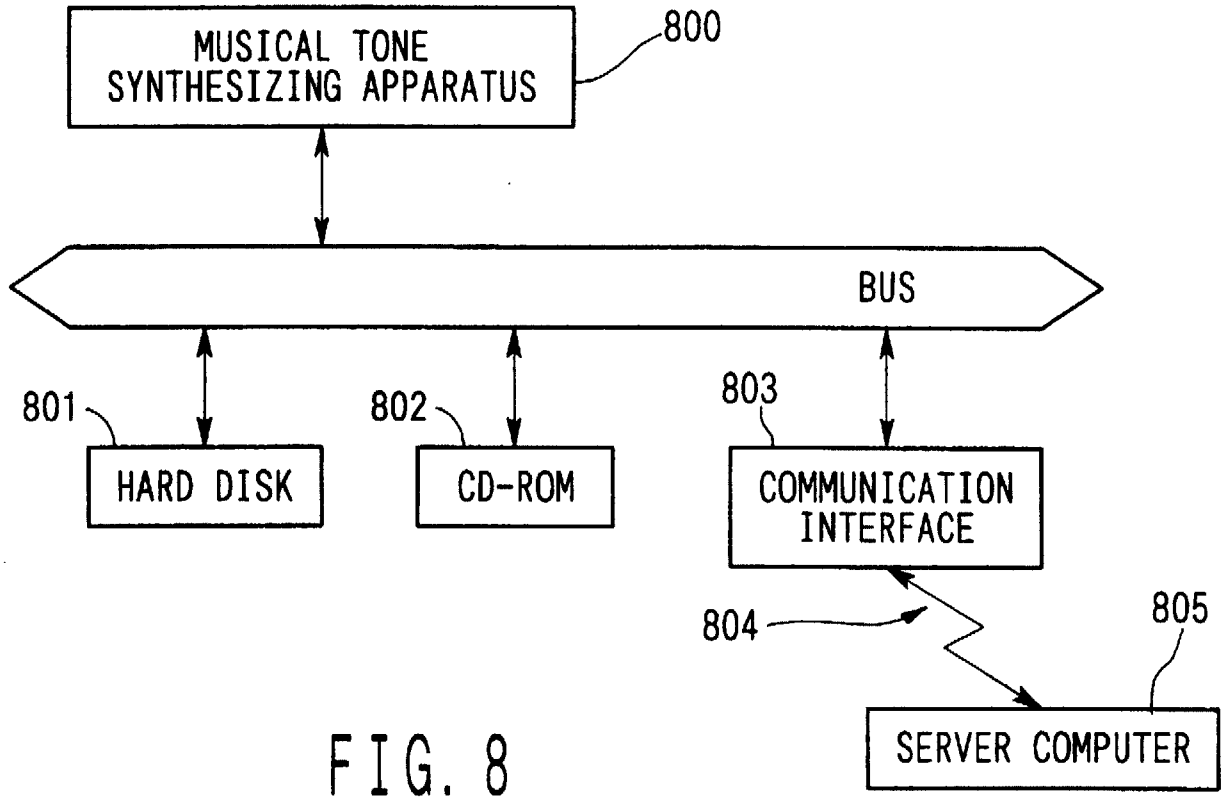
FIG. 8 is a block diagram showing a system to which this invention is applicable.

Now, applicability of this invention can be extended in a variety of manners. FIG. 8 shows a system containing a musical tone synthesizing apparatus 800 which corresponds to the embodiment of this invention. The musical tone synthesizing apparatus 800 is connected to a hard-disk unit 801, a CD-ROM unit 802 and a communication interface 803 via a bus. Herein, a variety of data and a variety of programs (e.g., programs realizing the musical-tone-synthesis algorithm of FIG. 2) are stored in the hard-disk unit 801 and/or a CD-ROM of the CD-ROM unit 802. Other than the CD-ROM, it is possible to employ any kinds of external storage media such as floppy disks and magneto-optic disks.

The communication interface 803 is connected to a communication network 804 such as a local area network (LAN), a computer network such as 'internet' or telephone lines. The communication network 804 is connected to a server computer 805. So, programs and data can be downloaded to the musical tone synthesizing apparatus 800 from the server computer 805. Herein, the system issues commands to request 'download' of the programs and data from the server computer 905; thereafter, the programs and data are transferred to the system and are stored in the hard-disk unit 801 and the like.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone synthesizing apparatus comprising:

an excitation envelope signal generator for generating an excitation envelope signal representing an excitation envelope;

a drive signal generator for generating a drive signal based on the excitation envelope signal;

a physical-model sound source for performing calculations, simulating a tone-generation mechanism of a musical instrument, by using the drive signal, thus producing a musical tone signal;

an amplitude envelope signal generator for generating an amplitude envelope signal representing an amplitude envelope;

a musical tone provider for imparting the amplitude envelope to the musical tone signal outputted from the physical-model sound source, thus providing a synthesized musical tone output; and an envelope controller, activated when receiving an instruction to generate a next note during generation of a current note, for controlling the excitation envelope signal generator to start formation of an attack portion following a current level of the excitation envelope, the envelope controller also controlling the amplitude envelope signal generator to temporarily damp a current level of the amplitude envelope to a damp level which is determined in advance, then, starting formation of an attack portion following the damp level of the amplitude envelope.

2. A musical tone synthesizing apparatus comprising:

an excitation envelope signal generator for generating an excitation envelope signal representing an excitation envelope, the excitation envelope signal generator starting formation of an attack portion following a certain level of the excitation envelope at a timing when receiving an instruction to generate a note;

a drive signal generator for generating a drive signal based on the excitation envelope signal;

a physical-model sound source for performing calculations, simulating a tone-generation mechanism of a musical instrument, by using the drive signal, thus producing a musical tone signal;

an amplitude envelope signal generator for generating an amplitude envelope signal representing an amplitude envelope, the amplitude envelope signal generator starting formation of an attack portion following a certain level of the amplitude envelope at a timing when receiving the instruction to generate the note;

a musical tone provider for imparting the amplitude envelope to the musical tone signal, outputted from the physical-model sound source, thus providing a synthesized musical tone output; and an envelope controller, activated when receiving an instruction to generate a next note during generation of a current note, for controlling the excitation envelope signal generator to start formation of an attack portion following a current level of the excitation envelope, the envelope controller also controlling the amplitude envelope signal generator to temporarily damp a level of the amplitude envelope to a damp level which is determined in advance, then, starting formation of an attack portion following the damp level of the amplitude envelope.

3. A musical tone synthesizing apparatus comprising:

a mode designator for designating either a first mode or a second mode;

an excitation envelope signal generator for generating an excitation envelope signal representing an excitation envelope;

a drive signal generator for generating a drive signal based on the excitation envelope signal;

a physical-model sound source for performing calculations, simulating a tone-generation mechanism of a musical instrument, by using the drive signal, thus producing a musical tone signal;

an amplitude envelope signal generator for generating an amplitude envelope signal representing an amplitude envelope;

a musical tone provider for imparting the amplitude envelope to the musical tone signal, outputted from the physical-model sound source, thus providing a synthesized musical tone output; and an envelope controller, activated when receiving an instruction to generate a next note during generation of a current note, for controlling the excitation envelope signal generator to start formation of an attack portion following a current level of the excitation envelope, regardless of designation of the first mode or the second mode, the envelope controller also controlling the amplitude envelope signal generator such that in the first mode, a current level of the amplitude envelope is temporarily damped to a damp level which is determined in advance, then, formation of an attack portion is started to follow the damp level of the amplitude envelope, whilst in the second mode, formation of an attack portion is started to follow a current level of the amplitude envelope.

4. A musical tone synthesizing apparatus according to claim 3 wherein the envelope controller makes a decision as to whether or not the current level of the amplitude envelope is greater than a predetermined level, so that if the current level of the amplitude envelope is not greater than the predetermined level, the envelope controller controls the amplitude envelope signal generator to start the formation of the attack portion following the current level of the amplitude envelope, whilst if the current level of the amplitude envelope is greater than the predetermined level, the envelope controller controls the amplitude envelope signal generator to continue generation of the amplitude envelope signal with regard to the current note.

5. A musical tone synthesizing apparatus comprising:

an excitation envelope signal generator for generating an excitation envelope signal representing an excitation envelope;

a drive signal generator for generating a drive signal using the excitation envelope signal in accordance with a manipulation of performance made by a human operator;

an excitation signal generator, activated by the drive signal, for generating an excitation signal on the basis of simulation of an operating behavior of a musical instrument;

a physical-model sound source for performing calculations, simulating a tone-generation mechanism of the musical instrument, on the excitation signal to produce a musical tone signal;

an amplitude envelope signal generator for generating an amplitude envelope signal representing an amplitude envelope;

a musical tone provider for imparting the amplitude envelope to the musical tone signal, thus providing a synthesized musical tone output; and an envelope controller, activated upon a receipt of an instruction to generate a next note during generation of a current note, for controlling the excitation envelope signal generator to start formation of an attack portion following a current level of the excitation envelope, the envelope controller also controlling the amplitude envelope signal generator to temporarily damp a level of the amplitude envelope to a damp level which is determined in advance, then, starting formation of an attack portion following the damp level of the amplitude envelope.

6. A musical tone synthesizing apparatus according to claim 5 wherein the musical tone provider imparts an effect to the musical tone signal as well.

7. A computer-readable media storing programs and parameters which cause a system using a processor to execute a musical-tone-synthesis method comprising the steps of:

generating an excitation envelope signal representing an excitation envelope;

generating a drive signal using the excitation envelope signal in accordance with a manipulation of performance made by a human operator;

generating an excitation signal, using the drive signal, on the basis of simulation of an operating behavior of a musical instrument;

performing calculations, simulating a tone-generation mechanism of the musical instrument, on the excitation signal to produce a musical tone signal;

generating an amplitude envelope signal representing an amplitude envelope;

imparting the amplitude envelope to the musical tone signal, thus providing a synthesized musical tone output; and controlling the excitation envelope signal and the amplitude envelope signal in level in response to an instruction to generate a next note during generation of a current note.

8. A computer-readable media according to claim 7 wherein the excitation envelope signal is controlled such that formation of an attack portion is started to follow a current level of the excitation envelope, whilst the amplitude envelope signal is controlled such that the amplitude envelope is temporarily damped in level to a damp level which is determined in advance, then, formation of an attack portion is started to follow the damp level of the amplitude envelope.

9. A computer-readable media according to claim 7 wherein the excitation envelope signal is controlled such that formation of an attack portion is started to follow a current level of the excitation envelope, whilst the amplitude envelope signal is controlled such that formation of an attack portion is started to follow a current level of the amplitude envelope.

10. A computer-readable media according to claim 7 wherein the excitation envelope signal is controlled such that formation of an attack portion is started to follow a current level of the excitation envelope, whilst if a current level of the amplitude envelope is greater than a predetermined level, the amplitude envelope signal is continuously generated with respect to the generation of the current note.

* * * * *